United States Patent [19]

Morkosky, Sr. et al.

[11] 4,413,312

[45] Nov. 1, 1983

[54] PORTABLE, HANGABLE LAMP WITH OUTLETS

[76] Inventors: Charles E. Morkosky, Sr.; Charles E. Morkosky, II, both of 809 Philadelphia Rd., Joppa, Md. 21085

[21] Appl. No.: 380,546

[22] Filed: May 21, 1982

[51] Int. Cl.[3] ..... F21V 21/26

[52] U.S. Cl. ..... 362/269; 362/263; 362/127; 362/145; 362/287; 362/295; 362/396; 362/399; 362/376; 362/400; 362/427; 362/310

[58] Field of Search ..... 362/183, 269, 295, 396, 362/127, 263, 145, 287, 399, 310, 400, 427, 376

[56] References Cited

U.S. PATENT DOCUMENTS

| | | | |
|---|---|---|---|
| 1,440,694 | 1/1923 | Potstada | 362/258 |
| 1,695,987 | 12/1928 | Steindorff | 362/396 |
| 2,561,691 | 4/1951 | Eckert et al. | 240/52.1 |
| 3,429,538 | 2/1969 | Natall | 248/228 |
| 3,578,282 | 5/1971 | Olsen | 248/214 |
| 3,584,213 | 6/1971 | Meltzer | 362/295 |
| 3,755,668 | 8/1973 | Moreschini | 362/396 |
| 3,772,527 | 11/1973 | Darling et al. | 362/396 |
| 3,828,181 | 8/1974 | Goodwin | 362/269 |
| 4,019,047 | 4/1977 | Frey | 362/396 |
| 4,275,435 | 6/1981 | Dorn | 362/396 |
| 4,369,487 | 1/1983 | Carlow | 362/396 |

FOREIGN PATENT DOCUMENTS

| | | | |
|---|---|---|---|
| 2759114 | 7/1979 | Fed. Rep. of Germany | 362/396 |

*Primary Examiner*—Stephen J. Lechert, Jr.
*Assistant Examiner*—Howard J. Locker
*Attorney, Agent, or Firm*—John F. McClellan, Sr.

[57] ABSTRACT

A high intensity lamp system for fireman's use and similar users provides a specially shaped base with an angle-adjustment of a reflector-equipped high intensity lamp extending from a junction box on the base; the base special shape includes at one end a "J"-section channel hook for hanging the system on a door or the like free of twisting; an arcuate cutout centrally in the edge of "J"-section channel hook provides for hanging the system on a nail or the like; at the opposite end of the base a planar projection of the base beyond the junction box provides for mounting the system by clamping or by slipping into a slot. The junction box receives a twist-lock type electrical supply plug in a socket for power input and provides two output sockets, eliminating need for extra extension cords. Special provisions permit adjusting the angle of the lamp head without danger of burning the hands of the user.

6 Claims, 7 Drawing Figures

PORTABLE, HANGABLE LAMP WITH OUTLETS

FIELD OF THE INVENTION

This invention relates generally to electrical devices and particularly to portable lighting devices powered by extension cords.

BACKGROUND OF THE INVENTION

In the prior art numerous portable lighting devices have been described, including some with adjustable reflectors, some with means for attachment to another object, and some with electrical outlets.

The following U.S. patents are representative of known art:

U.S. Pat. No. 1,440,694 issued to G. Potstada on Jan. 2, 1934 disclosed an electric lamp with reflector and adjustable joint standard connecting the reflector to a base;

U.S. Pat. No. 1,695,987 issued to U. F. L. Steindorf on Dec. 18, 1928, disclosed a portable electric lamp with members for attachment to another object;

U.S. Pat. No. 2,561,691 issued to G. E. Eckert and W. K. McGinty on July 24, 1951 disclosed a reflector type lamp in a socket having hinge-joint connection to a base which has a spring clip for hooking on a rail or the like to support the lamp;

U.S. Pat. No. 3,429,538 issued to D. Natale on Feb. 25, 1969 disclosed a reflector-type lamp with a hook-shaped bracket, and behind two hook-shaped members for attachment to fixed objects.

U.S. Pat. No. 3,578,282 disclosed a lamp with a clip-connection to a hook-shaped hanger.

OBJECTS OF THIS INVENTION

However, an adjustable-reflector high intensity, reflector-equipped lamp system with hooking provisions suited for hooking a wide variety of objects and for ground support, and providing a particularly oriented set of additional outlets, is not known to be available, and to provide such is a principal object of this invention.

Further objects are to provide an angle-adjustable twist-resistant system as described that can be set on a floor, hung over a door, hung over a ladder or a window (as when lighting a building, especially when it is desirable to have no interior cord to fall over), hung on a doorknob or a cabinet knob or a nail, or hung over an open ceiling joist, a pipe, an autotruck door, a window, or on a chair or other furniture.

In all these applications one lightweight, easily stored unit serves as a water-tight light and junction box eliminating need for multiple supply cords, and having selector switch control of whether the light, which may be a water-proof encased type, is in use at the same time as the junction box outlets. A pilot light indicates whether power is being supplied to the junction box, protective-contact provision help prevent heat damage to objects with which the system comes in contact in certain modes, and a convenient carrying handle is provided.

BRIEF DESCRIPTION OF THE DRAWINGS

The above and other objects and advantages of this invention will become more readily apparent on examination of the following description, including the drawings in which like reference numerals refer to like parts.

DETAILED DESCRIPTION

Figure 1:
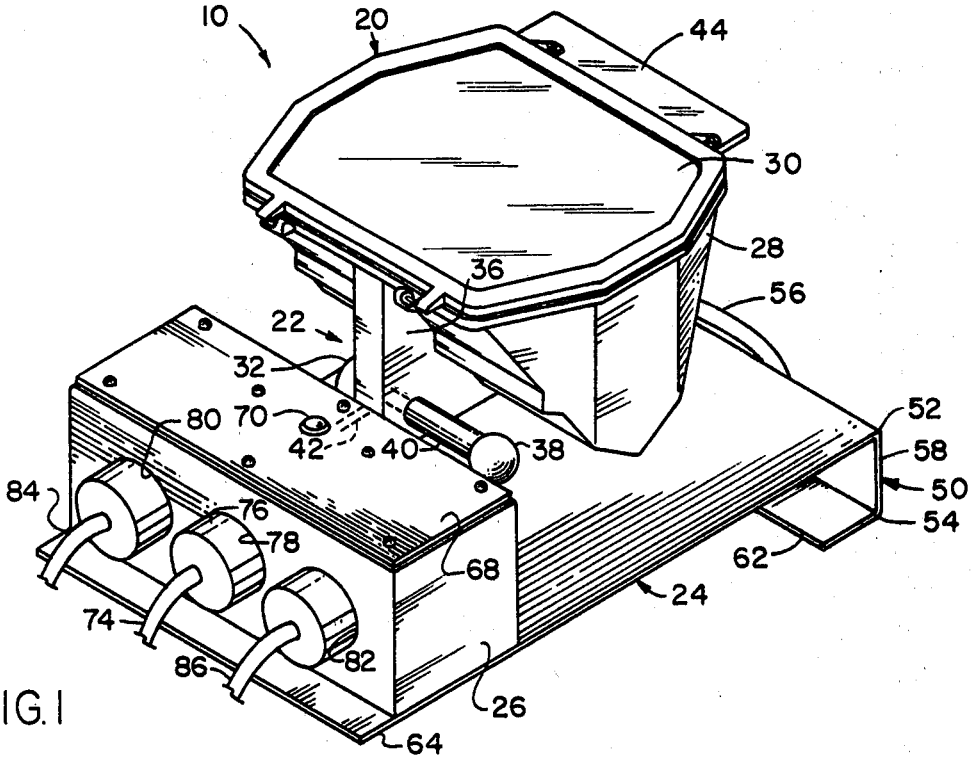
FIG. 1 is a perspective view of the invention as it might appear resting on the ground or on a floor.
Figure 2:
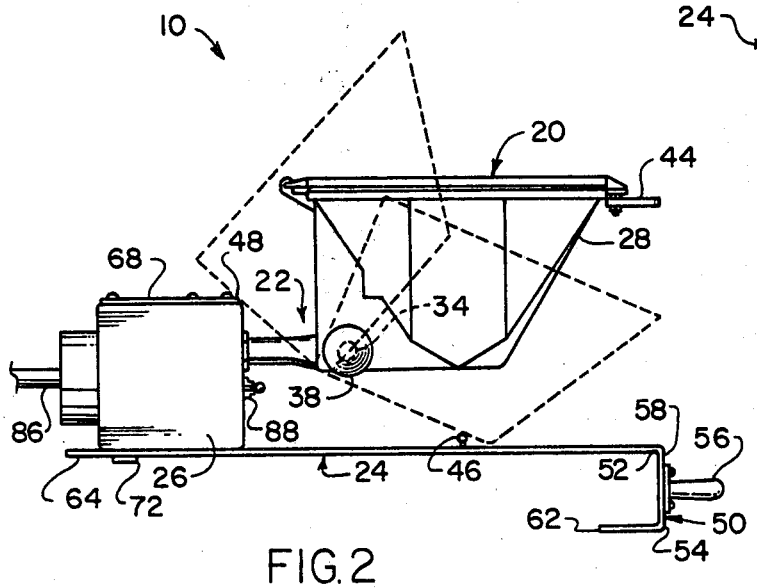
FIG. 2 is a side elevational view showing extreme adjustment-angle-positions in broken lines.
Figure 3:
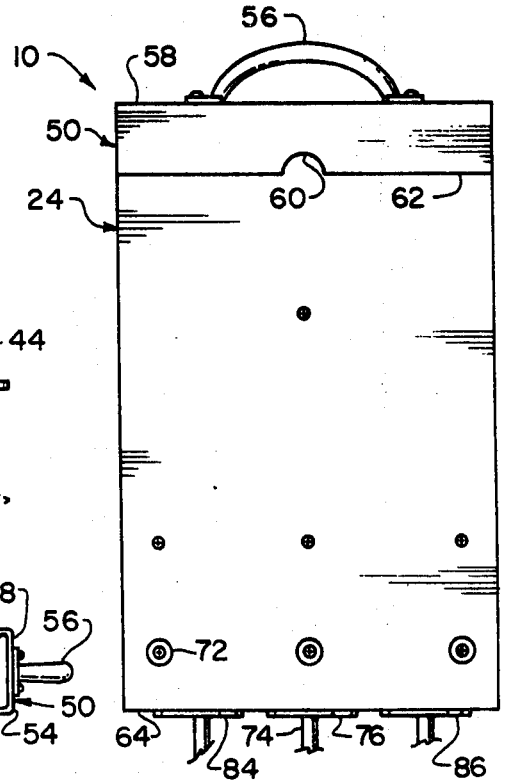
FIG. 3 is a rear elevational view as the system might appear when in a hanging mode.

FIGS. 1–3 show the system 10 as comprising generally a high-intensity protectively encased lamp head 20 with an adjustable mounting 22 to a base 24 which mounts junction box 26.

The high intensity head or lamp head 20 may be basically of the type sold by Crouse Hinds Company, Syracuse, N.Y., listed as Model No. QBD 500. It includes a reflector 28 with a gasketed, framed glass cover 30 sealing it. This particular model may use an iodine vapor lamp which is not suited for operation at all attitudes but other well-known available lamps such as incandescent lamps can be used and operated in it in all orientations.

This model includes a tubular mounting stem 32 from which a fixed threaded stud 34 projects (parallel with base 24) through a suitable hole in a flange 36 fixed to the reflector 28.

Provided according to this invention for manual adjustment is a threaded knob 38 or operative end engaging the free end of the stud at a location spaced from the flange 36 by a standoff sleeve 40 which is clamped between knob and flange like a washer to fix the angle of the lamp head relative to the base.

As one means of protecting a user against burns while adjusting the lamp head, the length of the stud and sleeve are such that the hand of a user will have room to manipulate the knob without touching the hot reflector. The electric lead 42 supplying the lamp head may pass entirely within the tube and flange or may conventionally pass in the open from the junction box to the reflector.

Another means of helping protect against burns is provided in the form of a "Lucite" or other thermally insulative plastic strip 44 protruding from the reflector free edge on the end away from the junction box 26.

Angle of ajustment of the lamp head 20 is safely limited by the base, as at a rest 46 (FIG. 2) and by the junction box 26 as at a similar screw-head rest 48.

The base 24 is a plate of aluminum with a "J"-channel-shaped hook 50 formed at the end distant the junction box by a first right-angle bend 52 away from the side mounting the junction box and a second right angle bend 54 returning the free end parallel with the base. A hollow (for coolness and lightness) arcuate handle 56 is mounted at a thermally remote location from the lamp, the heat path being through the lamp pivot, junction box and much of the heat dissipating base. The handle is held by screws at the ends, parallel with the base of the "J"-channel or outermost end 58 of the channel in the center. This may be grasped with one hand and the plastic strip 44 with the other in adjusting lamp head angle.

The "J"-hook provides a means for hanging the system. Center of gravity is in the longitudinal center plane. A further means for hanging is provided in the form of a cutout 60 (FIG. 3) in the returned edge 62; this is a self-centering cutout because it is central and arcuate in shape, and may be used to engage a nail or other small protrusion.

The base 24 protrudes at the end opposite the "J"-section channel or "J"-hook as a planar flange 64 which can be used in "C" clamping or otherwise affixing the system to the side of a truck or the like, or in slipping into a slot between a flange and a truck bed, for example, to retain the system.

The junction box 26 is a rectangular box, with a nearly square-cross-section, extending substantially from side-to-side of the base, like the lamp head, which it supports for simplicity in assembly. It has a removable gasketed top 68 screwed in place, with a pilot light 70 (FIG. 1) wired in parallel with the supply to indicate availability of current. Screws, including a line of screws with plastic or rubber feet 72 (FIGS. 2 and 3) captured under and protruding from the screw heads hold the junction box in water-tight relation to the base.

Current is supplied by a line 74 with a 120 volt 20 amp twist-lock type terminus 76 fitting into a socket 78 which may be centrally in the side of the junction box opposite the side supporting the lamp head, for clearance and ease of tactile and visual access, and for balance.

On each side of the supply socket 76 are output sockets 80, 82 for conventionally supplying respective extension cords 84, 86 with current for any desired purpose.

A toggle switch 88 (FIG. 2) preferably of the bellows-protected water-tight type provides means for selectively turning the high-intensity light on and off.

Figure 4:
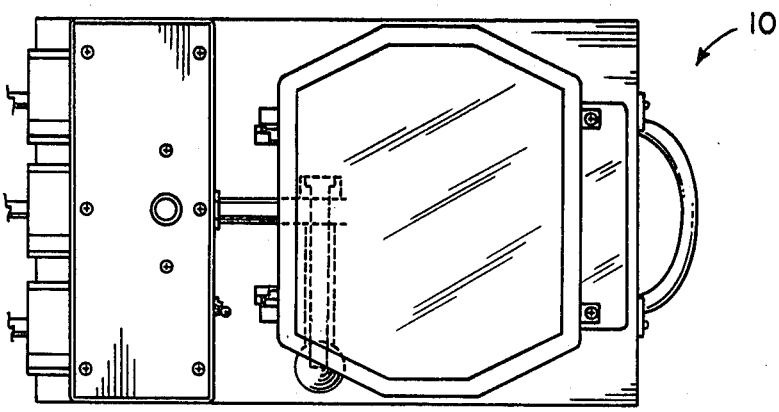
FIG. 4 is a face view of the invention as it might appear laid on the side and if the page is rotated 90° is a front elevational view.

FIG. 4 shows how the system 10 can be laid on the side, with the right lamp, to floodlight an area.

Figure 5:
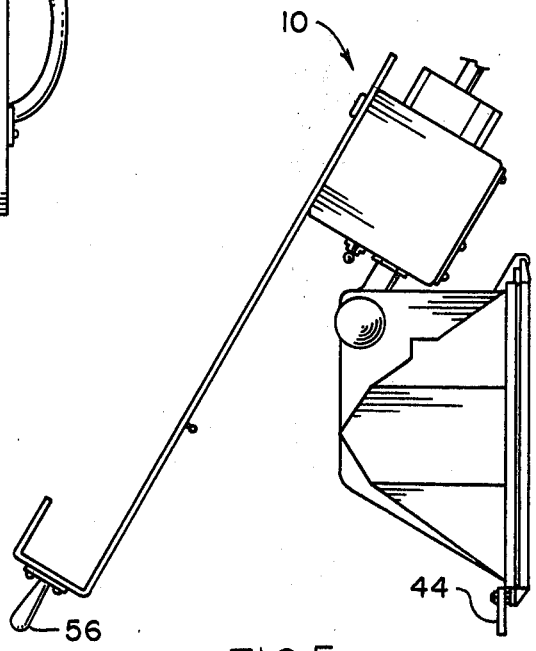
FIG. 5 is a side elevational view of the system showing an inverted mode of use resting on a surface.

FIG. 5 shows that the system 10 can be stood on the reltively cool handle 56 and on the plastic plate 44 for angle-adjustable support on a surface that might be susceptible to heat damage, such as a floor.

Figure 6:
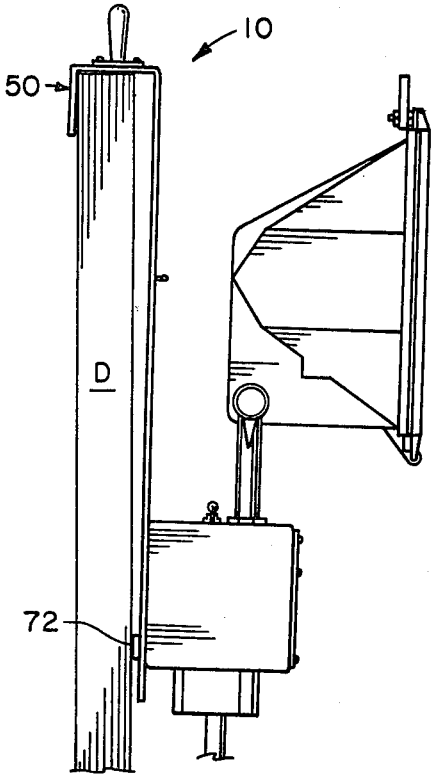
FIG. 6 is a side elevational view of the system in use hung over a door.

FIG. 6 shows the system 10 hung on a door D by the "J"-hook 50 and cushioned by the protruding feet 72.

Figure 7:
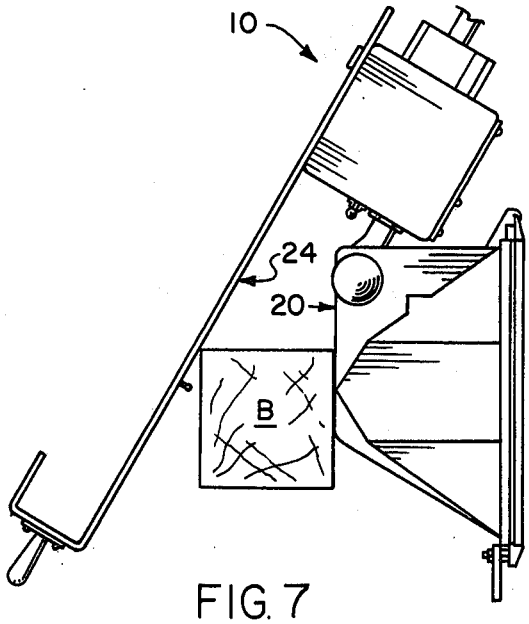
FIG. 7 is a view similar to that of FIG. 5, but with the system hung over a beam.

FIG. 7 shows how large rough objects such as a beam B or a pipe can be used for hanging, the base 24 and the lamp head 20 forming a "V" recess for holding them.

Dimensions may be such that the overall length of the system is 16 inches (41 cm), width 10 inches (25 cm), depth 10 inches (25 cm). Base thickness may be $\frac{1}{8}$ inch (3.1 mm). Aluminum is the preferred construction material for lightness, less than ten pounds (4.5 kg) non-corrosion and strength.

It will be appreciated that all wiring of plugs, sockets, pilot lamp and high intensity lamp and switch is conventional, and so is not described in detail.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system of high intensity reflector-equipped lamp, base, current input means, current output means, and hanging means, the improvement comprising: means for manually adjusting the angle of the high-intensity reflector-equipped lamp relative to said base, means for preventing burning of the hands during said manual adjusting, said hanging means including means for hanging the system on doors and the like free of twisting when hung; the current output means including a junction box; the means for manually adjusting including: a pivotal connection mounting the high intensity reflector-equipped lamp to the junction box and means for clamping said pivotal connection; the means for preventing burning comprising: a thermally insulative strip on said reflector located for gripping during said manual adjusting, a handle on said base thermally remote from the high-intensity reflector-equipped lamp and located for gripping during said manual adjusting, and said means for clamping having an operative end with a standoff, the standoff locating the operative end away from said high intensity reflector-equipped lamp.

2. In a system as recited in claim 1, said base comprising a plate, the means for hanging the system on doors and the like free of twisting when hung, including a "J"-section channel formed in said plate on an end thereof remote from said means for manually adjusting.

3. In a system as recited in claim 2, said "J"-section channel having a returned end portion, and means for hanging said system on a nail and the like comprising structure defining an arcuate notch centrally in said returned end portion.

4. In a system as recited in claim 3, said "J"-section channel having a portion forming a first end of said system, and said handle on said first end centrally of said notch.

5. In a system as recited in claim 2, said current input means including said junction box and extending across a portion of said plate, and means for being clamped for fastening said plate to an object, comprising a portion of said plate projecting from beneath said junction box as a second end of said plate.

6. In a system as recited in claim 5, said means for being clamped having a plurality of cushioned portions thereon.

* * * * *